US008413447B2

(12) United States Patent
Cihlar

(10) Patent No.: US 8,413,447 B2
(45) Date of Patent: Apr. 9, 2013

(54) FUEL NOZZLE CUP SEAL

(75) Inventor: David Cihlar, Greenville, SC (US)

(73) Assignee: General Electric Company, Schenectady, NY (US)

( * ) Notice: Subject to any disclaimer, the term of this patent is extended or adjusted under 35 U.S.C. 154(b) by 788 days.

(21) Appl. No.: 12/560,526

(22) Filed: Sep. 16, 2009

(65) Prior Publication Data

US 2011/0062253 A1 Mar. 17, 2011

(51) Int. Cl.
*F02G 1/00* (2006.01)

(52) U.S. Cl. ..... 60/740; 60/756

(58) Field of Classification Search ..... 277/635; 60/737, 740, 752, 756
See application file for complete search history.

(56) References Cited

U.S. PATENT DOCUMENTS 5,749,218 A * 5/1998 Cromer et al. ..... 60/796
6,547,256 B2 * 4/2003 Aksit et al. ..... 277/628
2008/0053107 A1 * 3/2008 Weaver et al. ..... 60/800

OTHER PUBLICATIONS

Geoffrey D. Myers, Title: "Combustion Cap Floating Collar Using E-Seal", U.S. Appl. No. 12/078,101, filed Mar. 27, 2008, pgs. Specification 1-13, Drawings 8 sheets.

* cited by examiner

*Primary Examiner* — Gerald Sung
(74) *Attorney, Agent, or Firm* — Sutherland Asbill & Brennan LLP

(57) ABSTRACT

The present application provides a fuel nozzle assembly. The fuel nozzle assembly may include an end cap assembly, a number of fuel nozzles positioned within the end cap assembly, and one or more cup seals. The cup seals may be positioned between the end cap assembly and the fuel nozzles.

20 Claims, 4 Drawing Sheets

FUEL NOZZLE CUP SEAL

TECHNICAL FIELD

The present application relates generally to gas turbine engines and more particularly relates to a cup seal used to position a fuel nozzle within an end cap assembly of a turbine combustor.

BACKGROUND OF THE INVENTION

Gas turbine engines generally include a combustor with a number of fuel nozzles positioned about an end cap assembly in various configurations. For example, several gas turbine combustion system offered by General Electric Corporation of Schenectady, N.Y. provide a six (6) fuel nozzle configuration with a center or a secondary fuel nozzle surrounded by five (5) outer or primary fuel nozzles extending from the end cap assembly. Such combustion systems generally mix together one or more fuel streams and air streams before entry of the mixed stream into a reaction or a combustion zone. Such fuel/air premixing tends to reduce overall combustion temperatures as well as undesirable emissions such as nitrogen oxides ($NO_x$) and the like. Similar types of fuel nozzle/end cap assembly designs for combustors and the like are known.

As is known, fuel nozzles generally include a number of fuel and air tubes mounted onto a flange. The fuel nozzles may be positioned within the end cap assembly in a somewhat cantilevered fashion. The fuel nozzles may be positioned within the end cap assembly via a number of floating collars. The floating collars generally fit over the outside surface of the fuel nozzle burner tubes. The floating collars provide function as air seals. The floating collars, however, may experience significant wear during operation. Specifically, the collars may rotate during use so as to cause friction between the collars and the end cap assembly. Replacement and durability of the floating seals thus are common design issues.

There is a desire therefore for an improved seal between the fuel nozzles and the end cap assembly. The seals should improve the durability of the overall combustor in a low cost but reliable fashion.

SUMMARY OF THE INVENTION

The present application thus provides a fuel nozzle assembly. The fuel nozzle assembly may include an end cap assembly, a number of fuel nozzles positioned within the end cap assembly, and one or more cup seals. The cup seals may be positioned between the end cap assembly and the fuel nozzles.

The present application further provides for an end cap assembly. The end cap assembly may include a number of fuel nozzles positioned therein and one or more cup seals positioned about the fuel nozzles. The cup seals may include an attachment ring and a sheet seal.

These and other features and improvements of the present application will become apparent to one of ordinary skill in the art upon review of the following detailed description when taken in conjunction with the several drawings and the appended claims.

DETAILED DESCRIPTION

Figure 1:
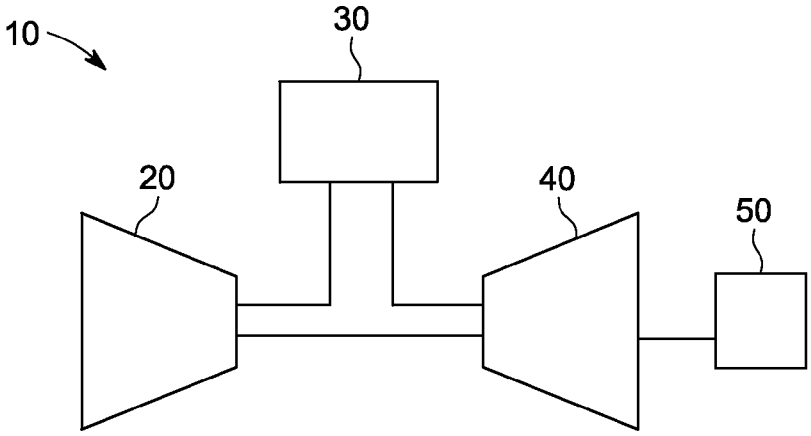
FIG. 1 is a schematic view of a gas turbine engine.

Referring now to the drawings, in which like numbers refer to like elements throughout the several views, FIG. 1 shows a schematic view of a gas turbine engine 10. As is known, the gas turbine engine 10 may include a compressor 20 to compress an incoming flow of air. The compressor 20 delivers the compressed flow of air to a combustor 30. The combustor 30 mixes the compressed flow of air with a compressed flow of fuel and ignites the mixture. (Although only a single combustor 30 is shown, the gas turbine engine 10 may include any number of combustors 30.) The hot combustion gases are in turn delivered to a turbine 40. The hot combustion gases drive the turbine 40 so as to produce mechanical work. The mechanical work produced by the turbine 40 drives the compressor 20 and an external load 50 such as an electrical generator and the like. The gas turbine engine 10 may use natural gas, various types of syngas, and other types of fuel. The gas turbine engine 10 may have other configurations and may use other types of components herein.

Figure 2:
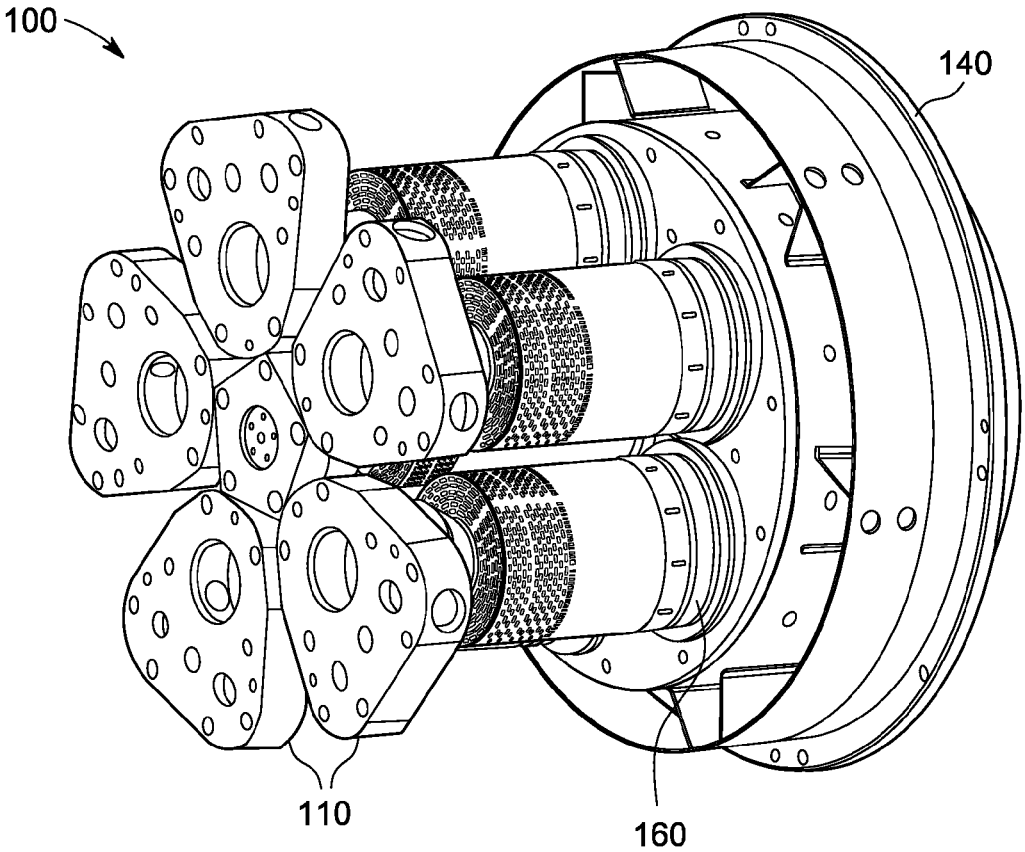
FIG. 2 is a perspective view of a fuel nozzle assembly as may be described herein.

FIG. 2 is a perspective view of a fuel nozzle assembly 100 as may be described herein. As described above, the fuel nozzle assembly 100 may include a number of primary nozzles 110 surrounding a secondary nozzle 120. The nozzles 110, 120 may be positioned within and through a number of apertures 130 within an end cap assembly 140. Each of the apertures 130 may have an indent 150 or a slight step down encircling the aperture 130 in whole or in part. The fuel nozzle assembly 110 as a whole is positioned within the combustor 30. Other types of fuel nozzle assembly designs may be used herein.

Figure 3:
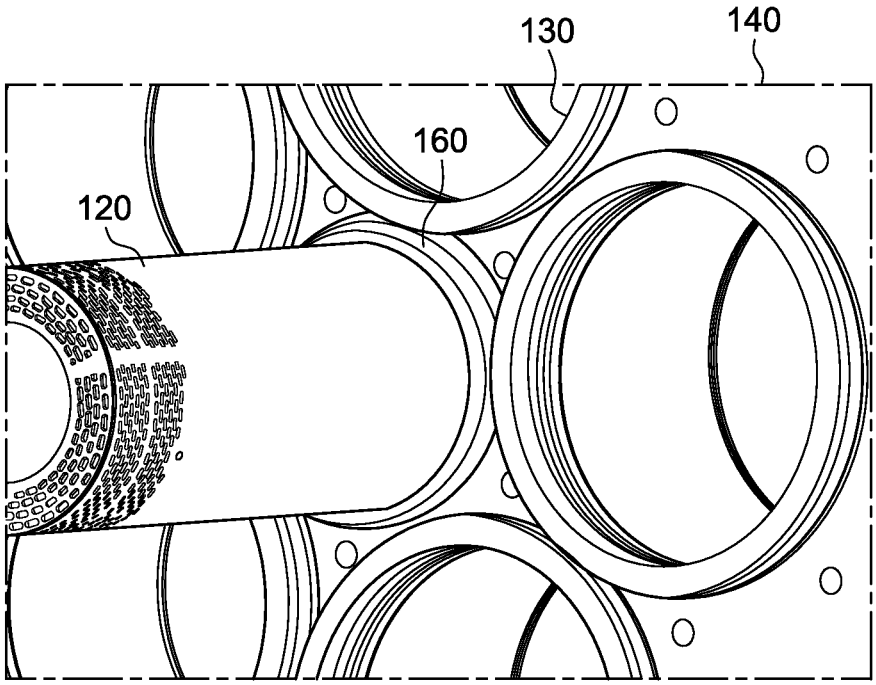
FIG. 3 is a perspective view of a secondary nozzle positioned within the end cap assembly and a cup seal as may be described herein.
Figure 4:
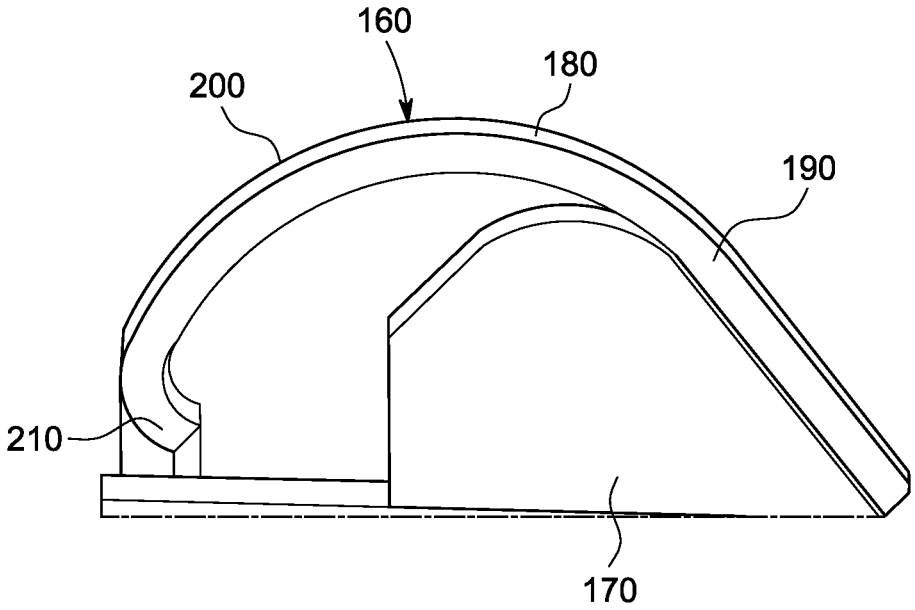
FIG. 4 is a side cross-sectional view of the cup seal of FIG. 3.
Figure 5:
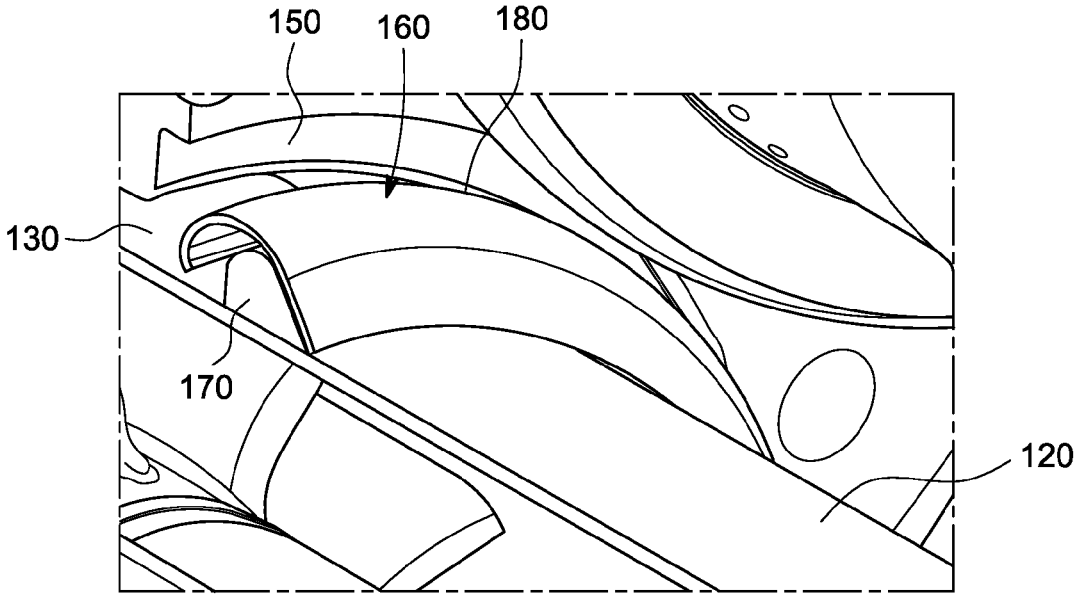
FIG. 5 is a side cutaway view of the fuel nozzle, the end cap assembly, and the cup seal of FIG. 3.

FIGS. 3-5 show the secondary nozzle 120 positioned within the end cap assembly 140 with a cup seal 160 as is described herein. The cup seal 160 may include an attachment ring 170 attached to the secondary nozzle 120. The attachment ring 170 may be a separate element or formed as part of the fuel nozzle 120 itself. The attachment ring 170 may be made out of Inconel (a nickel-chromium superalloy offered by Huntington Alloys Corporation of Huntington, W. Va.), Hastelloy X (a nickel-chromium-iron molybdenum superalloy offered by Haynes International of Kokomo, Ind.), stainless steel, or other types of materials similar to those used for the fuel nozzle 120 itself. The attachment ring 170 may surround the fuel nozzle 120 in whole or in part. The attachment ring 170 may have any desired size, shape, or configuration.

The cap seal 160 further may includes a sheet seal 180. The sheet seal 180 may be made out of sheet metal or similar types of materials. The sheet seal 180 may be attached to the attachment ring 170. The sheet seal 180 may be largely cup like in shape with a largely straight portion 190 leading to an extended curved portion 200 and ending in a slight curl portion 210. Other shapes and configurations may be used herein. The curved portion 200 and the curl portion 210 may extend beyond the attachment ring 170. The sheet seal 180 may be attached to the attachment ring 170 via welding, bolting, and other types of attachment techniques. The sheet seal 180 may have any desired size.

In use, the cup seal 160 may be positioned between the fuel nozzle 120 and the end cap assembly 140. As described above, the attachment ring 170 may be attached to the nozzle 120 while the sheet seal 180 extends beyond the attachment ring 170 and into the indent 150 surrounding the center aperture 130 of the end cap assembly 140. Other configurations may be used herein. The cup seal 160 is designed to be a sacrificial part so as to allow for improved sealing, i.e., the sealing capability of the cup seal 160 may improve with use. The cup seal 160 also provides easy replacement and reinstallation with no subsequent damage or significant loading on the nozzle 120.

Specifically, the cup seal 160 should provide a reduction in wear and in durability issues given the relative motion between the nozzle 120, the cup seal 160, and the end cap assembly 140. The cap seal 160 should reduce this motion by providing an axial seal interface. As compared to existing seals, the cup seal 160 eliminates one degree of motion so as to improve wear and durability. The cup seal 160 thus provides for low leakage with free radial motion, i.e., the cup seal 160 provides unrestricted radial motion with no degradation in the sealing capability. The seal 160 may be retrofitted into existing hardware or incorporated into new designs.

Figure 6:
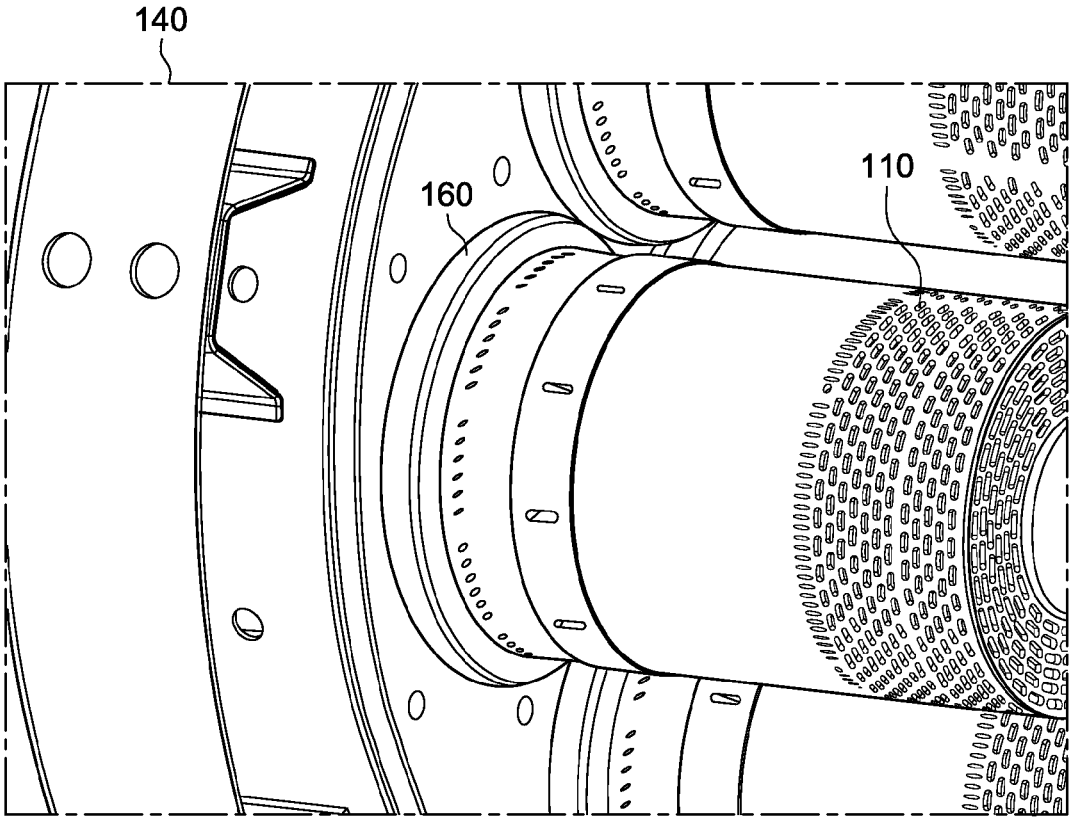
FIG. 6 is a perspective view of a primary nozzle positioned within the end cap assembly and the cup seal as is described herein.
Figure 7:
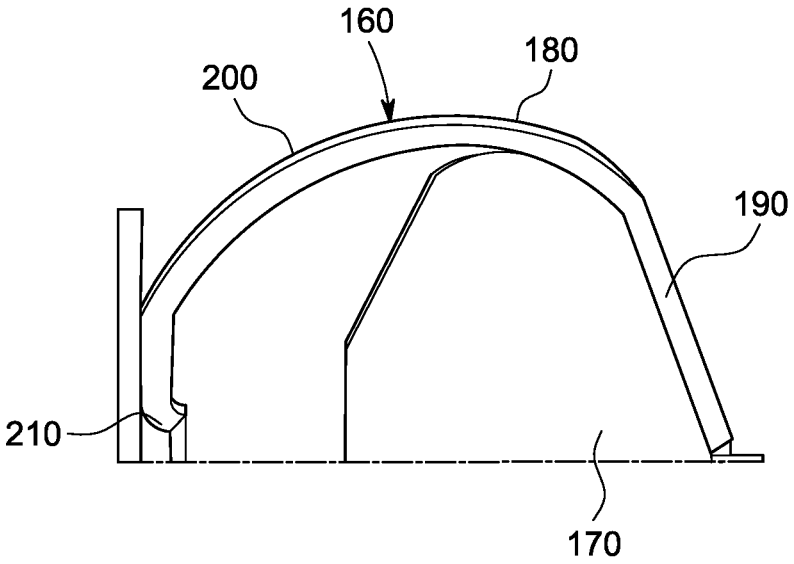
FIG. 7 is a side cross-sectional view of the cup seal of FIG. 6.
Figure 8:
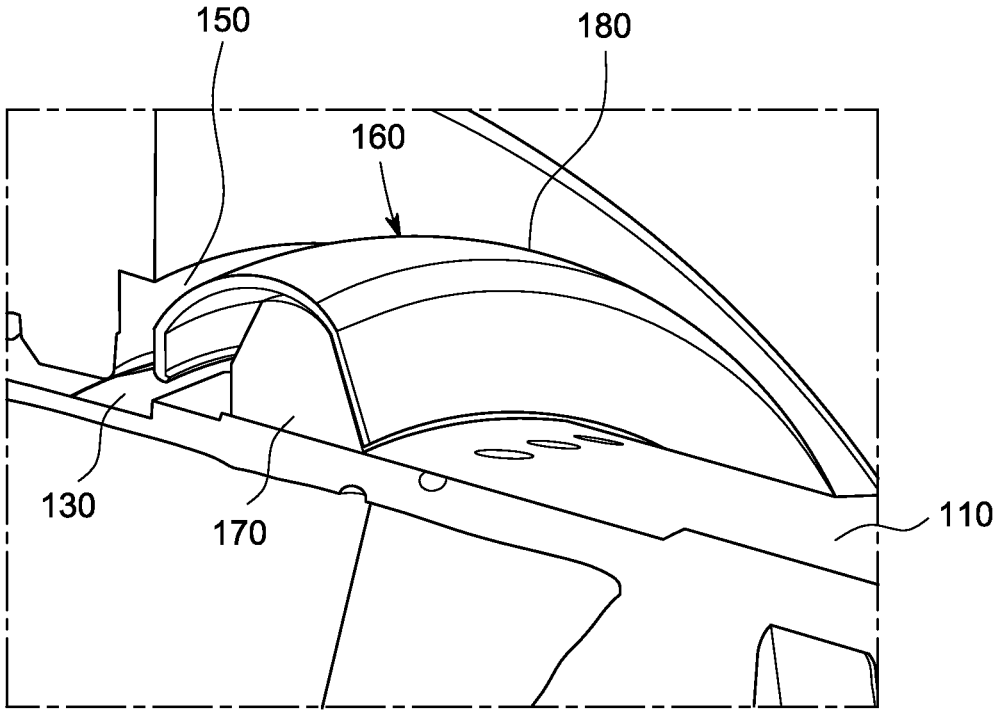
FIG. 8 is a side cutaway view of the fuel nozzle, the cap assembly, and the cup seal of FIG. 6.

FIGS. 6-8 show the use of the cup seal 160 about one of the primary nozzles 110. As is shown, the cup seal 160 includes the attachment ring 170 that is attached to the primary nozzle 110 with the sheet seal 180 extending therefrom and being in contact with the indent 150 of the aperture 130. The cup seal 160 may be used in each of the apertures 130 of the primary nozzles 110 and elsewhere. Other configurations may be used herein.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

I claim:

1. A fuel nozzle assembly, comprising:

an end cap assembly defining an aperture extending through the end cap assembly, wherein the aperture comprises a counterbore;

a fuel nozzle positioned within and extending through the aperture of the end cap assembly; and a cup seal positioned between the end cap assembly and the fuel nozzle, wherein a portion of the cup seal is positioned within the counterbore of the aperture.

2. The fuel nozzle assembly of claim 1, wherein the cup seal comprises an attachment ring and a sheet seal.

3. The fuel nozzle assembly of claim 2, wherein the attachment ring surrounds the fuel nozzle.

4. The fuel nozzle assembly of claim 2, wherein the sheet seal extends from the attachment ring into the aperture.

5. The fuel nozzle assembly of claim 4, wherein the sheet seal extends into the counterbore of the aperture.

6. The fuel nozzle assembly of claim 2, wherein the sheet seal comprises a straight portion leading to a curved portion and ending in a curl portion.

7. The fuel nozzle assembly of claim 1, wherein the fuel nozzle comprises a primary nozzle.

8. The fuel nozzle assembly of claim 1, wherein the fuel nozzle comprises a secondary nozzle.

9. The fuel nozzle assembly of claim 1, wherein the cup seal comprises a sacrificial part.

10. The fuel nozzle assembly of claim 1, wherein the cup seal comprises an axial seal.

11. The fuel nozzle assembly of claim 1, wherein the cup seal contacts the fuel nozzle and the aperture of the end cap assembly.

12. An end cap assembly, comprising:

an aperture extending through the end cap assembly, wherein the aperture comprises a counterbore;

a fuel nozzle positioned within and extending through the aperture; and a cup seal positioned about the fuel nozzle, wherein the cup seal comprises an attachment ring and a sheet seal, and wherein a portion of the cup seal is positioned within the counterbore of the aperture.

13. The end cap assembly of claim 12, wherein the attachment ring surrounds the fuel nozzle.

14. The end cap assembly of claim 12, wherein the sheet seal extends from the attachment ring into the aperture.

15. The end cap assembly of claim 14, wherein the sheet seal extends into the counterbore of the aperture.

16. The end cap assembly of claim 12, wherein the sheet seal comprises a straight portion leading to a curved portion and ending in a curl portion.

17. The end cap assembly of claim 12, wherein the fuel nozzle comprises a primary nozzle.

18. The end cap assembly of claim 12, wherein the fuel nozzle comprises a secondary nozzle.

19. The end cap assembly of claim 12, wherein the cup seal comprises a sacrificial part.

20. The end cap assembly of claim 12, wherein the cup seal comprises an axial seal.

* * * * *